US010832866B2

(12) United States Patent
Cobos Reyes et al.

(10) Patent No.: US 10,832,866 B2
(45) Date of Patent: Nov. 10, 2020

(54) DEVICE FOR FORMING A TOROIDAL COIL AND METHOD FOR FORMING A TOROIDAL COIL

(71) Applicant: PREMO, S.A., Campanillas (ES)

(72) Inventors: Sergio Cobos Reyes, Barcelona (ES); Antonio Rojas Cuevas, Barcelona (ES); Juan Fernandez Reina, Barcelona (ES); Juan Antonio Jimenez Pavon, Barcelona (ES)

( * ) Notice: Subject to any disclaimer, the term of this patent is extended or adjusted under 35 U.S.C. 154(b) by 817 days.

(21) Appl. No.: 15/303,805

(22) PCT Filed: Mar. 31, 2015

(86) PCT No.: PCT/ES2015/070258
§ 371 (c)(1),
(2) Date: Oct. 13, 2016

(87) PCT Pub. No.: WO2015/158943
PCT Pub. Date: Oct. 22, 2015

(65) Prior Publication Data

US 2017/0040106 A1 Feb. 9, 2017

(30) Foreign Application Priority Data

Apr. 16, 2014 (ES) ..... 201430571

(51) Int. Cl.
*H01F 41/08* (2006.01)
*H01F 41/04* (2006.01)

(52) U.S. Cl.
CPC ..... *H01F 41/08* (2013.01)

(58) Field of Classification Search
CPC ..... H01F 41/08; H01F 41/06; H01F 41/04; H01F 41/02; H01F 41/00; Y10T 29/49071; Y10T 29/4902; Y10T 29/49073
(Continued)

(56) References Cited

U.S. PATENT DOCUMENTS 3,401,282 A * 9/1968 Zagorski ..... H02K 23/04 310/428
3,483,497 A * 12/1969 Clark ..... H01F 19/08 336/96

(Continued)

FOREIGN PATENT DOCUMENTS

JP H02152875 A 6/1960
JP 2002289455 A 10/2002

OTHER PUBLICATIONS

International Search Report and written opinion of PCT/ES2015/070258 dated Jun. 26, 2015.

*Primary Examiner* — Peter Dungba Vo
*Assistant Examiner* — Kaying Kue
(74) *Attorney, Agent, or Firm* — Eugenio J. Torres-Oyola; Victor M. Rodriguez-Reyes; Rafael Rodriguez-Muriel

(57) ABSTRACT

The device comprises an annular guide component (1) that defines a central space (5) for accommodating the toroidal magnetic core (4) and comprises a plurality of channels (2) for receiving parts of a wire that form turns (3) of said toroidal coil upon arrangement about the toroidal magnetic core (4), said channels (2) being arranged transversely, from end face to end face of the annular guide component (1), distributed over an interior annular wall (1*i*) and separated from one another in accordance with a predetermined order. The method comprises use of the device of the invention for forming a toroidal coil comprising one or more windings.

9 Claims, 8 Drawing Sheets

(58) Field of Classification Search
USPC ..... 29/5, 606, 602.1, 732, 733–736, 605
See application file for complete search history.

(56) References Cited

U.S. PATENT DOCUMENTS 4,443,934 A * 4/1984 Hickey ..... H02K 1/17 29/593
4,608,752 A * 9/1986 Muller ..... H02K 1/278 29/598
5,274,907 A 1/1994 Moorehead
5,774,976 A * 7/1998 Stark ..... H01F 41/0253 29/732
6,148,500 A * 11/2000 Krone ..... H01F 17/0033 29/602.1
6,181,130 B1 * 1/2001 Hoshi ..... G01R 33/05 324/253
6,617,948 B2 * 9/2003 Kuroshima ..... H01F 17/043 29/602.1
2013/0104863 A1 * 5/2013 Arroyo ..... H01F 41/066 123/621
2015/0380150 A1 * 12/2015 Sommer ..... H01F 3/10 336/192
2016/0372259 A1 * 12/2016 Banba ..... H01F 17/062
2018/0350501 A1 * 12/2018 Hasegawa ..... H01F 17/06

* cited by examiner

DEVICE FOR FORMING A TOROIDAL COIL AND METHOD FOR FORMING A TOROIDAL COIL

RELATED APPLICATIONS

This application is the US national phase application of international application number PCT/ES2015/070258, filed 31 Mar. 2015, which designates the US and claims priority to Spanish Patent Application No. P201430571 filed 16 Apr. 2014, the contents of each of which are hereby incorporated by reference as if set forth in their entireties.

FIELD OF THE ART

The present invention generally relates in a first aspect to a device for forming a toroidal coil, formed by one or more windings, and more particularly to a device that positions the turns of the toroidal coil following a predetermined order.

A second aspect of the invention relates to a method for forming a toroidal coil which comprises using the device of the first aspect.

PRIOR STATE OF THE ART

Toroidal coils are used for various applications, many of which have requirements that are not too demanding as regards the order of turns. Nevertheless, there are some fields of application that require toroidal coils with a very specific and precise order of turns, particularly in relation to the distances between them. This is the case of wireless chargers for batteries of different types of devices or systems, such as mobile telephones or even electric vehicles, that work by means of inductive coupling, sometimes resonant inductive coupling, between the coils of an emitter arranged in the charger and the coils of a receiver arranged or connected with the device or system operating by means of battery. In such application, the more precise the order of turns is and the more similar it is in both coils and/or the windings of each coil (if the latter include more than one winding), i.e., the greater the symmetry between the coils and/or the windings is, the better the inductive coupling obtained will be, which will increase the performance of the charging process.

U.S. Pat. No. 5,274,907 proposes a system including a device for forming a toroidal coil that combines the features of the preamble of claim 1 of the present invention, as it includes a guide component including on a face channels for receiving portions of a wire that form turns of the toroidal coil when being arranged around a toroidal magnetic core, in this case for the passage of the wire during winding. The tool described in said patent is used for helically winding toroidal cores that is carried out with the wire being fed continuously which is unlike most toroid winding machines in which the wire content is loaded on a C-shape annular structure which is then closed on the core, which rotates while the wire rotates describing the helical winding on the toroid body.

The guide component of patent document U.S. Pat. No. 5,274,907 adopts a curved shape and the channels are arranged longitudinally following the curvature of the guide component, on an inner face thereof. To wind the core, the guide component is fixed to a support, arranged with the channels transversely opposing the core and the latter is rotated while the wire is being inserted through the channels of the component, such that the wire is helically wound around the core, forming the turns.

A specific spacing between turns cannot be assured by means of using the device proposed in patent document U.S. Pat. No. 5,274,907 since it will depend not only on the distance between channels but also on other factors, such as the rotational speed of the core and wire supply speed, among others.

For the demanding applications indicated above which require a very precise order of turns that cannot be assured with the devices of the state of the art, a large number of manufactured coils must be verified for the purpose of assuring a minimum quality level.

Patent documents JP2002289455A and JPH02152875A describe respective devices for forming a toroidal coil, each of which comprises a guide component having a single channel in the form of a turn defined on an inner face to be arranged opposite an outer face of the toroidal magnetic core. Such arrangement that consists of a single channel makes winding of the turns around the toroidal magnetic core more difficult, since the wire must run through the entire path formed by the channel for complete winding without being able to come out unless it has reached the final end of the channel, which means that, for example, it may get caught if the winding movements are not precise enough or if there is an obstacle within the channel. Likewise, such device would not allow forming two or more windings around the core, or winding toroidal cores having a rectangular section.

DESCRIPTION OF THE INVENTION

It seems necessary to provide an alternative to the state of the art which covers the drawbacks existing in relation to the devices for forming toroidal coils, and which allows obtaining toroidal coils with very precise orders of turns that offers sufficient assurances so as to do without the coil verification process, or at least to reduce it to the verification of only a small sample of the manufactured coils.

To that end, the present invention relates in a first aspect to a device for forming a toroidal coil comprising a guide component including channels for receiving portions of a wire (generally copper wire) that form turns of said toroidal coil when being arranged around a toroidal magnetic core, said channels being defined on a face of said guide component to be arranged opposite an outer face of said toroidal magnetic core.

Unlike the known devices, particularly unlike the device of patent document U.S. Pat. No. 5,274,907, in the device of the first aspect of the invention the guide component, in a characteristic manner, has an annular shape with an annular inner wall demarcating a central space for accommodating the toroidal magnetic core, and comprises a plurality of said channels arranged transversely, from base to base of the annular guide component, distributed throughout the annular inner wall separated from one another in accordance with a predetermined order.

The device proposed by the first aspect of the invention is suitable for forming a toroidal coil with one or more windings.

For a preferred embodiment, said predetermined order includes arranging the channels equidistantly, so the channels of the plurality of channels are separated equidistantly from one another.

According to other less preferred embodiments, the predetermined order includes different separation distances between channels or groups of channels.

Generally, the annular guide component is made of a dielectric material, such as plastic or the like.

The mentioned channels preferably run parallel with respect to one another and with respect to the geometric central axis of the annular guide component.

For one embodiment, the mentioned central space is demarcated by the interstitial portions between channels of the annular inner wall and has a diameter larger than the outer diameter of the toroidal magnetic core.

According to one embodiment, the device comprises projections at at least one end of part of or all the interstitial portions for supporting the toroidal magnetic core by one of its larger faces or bases.

For one embodiment, the annular guide component is a single component, the toroidal magnetic core being inserted into the housing defined by the component, or vice versa, through one of the opposite mouths of the central hole of the annular guide component.

For an alternative embodiment, the annular guide component comprises two annular guide half-components or parts that can be coupled to one another at two of their respective opposing bases, or coupling bases.

According to one embodiment, each of said annular guide half-components comprises a plurality of projections at an end of part of or all their respective interstitial portions, where said end is the end which is close to or in contact with the base of the annular guide semi-component opposite the coupling base, for supporting the toroidal magnetic core by both of its larger faces or bases.

Alternatively, for other embodiments (that are valid both for the case in which the guide component is a single component and for the case in which it is split into two parts), the device comprises another type of configurations for supporting and/or holding the magnetic core, such as elastically deformable elements arranged at different points along the inner wall of the guide component, or formed by different areas of the inner wall itself, which securely hold the core by its outer circumferential contour. For holding by means of elastic deformation, the inner diameter defined by the circular perimeter occupied by such elastic elements is slightly smaller than the outer diameter of the toroidal magnetic core, such that a small pressure must be applied to insert the core into the housing of the annular guide component.

The mentioned coupling bases comprise respective complementary coupling configurations to couple the two annular guide half-components to one another, trapping the toroidal magnetic core between them.

According to one embodiment, said coupling configurations comprise respective pins and openings arranged in the coupling bases opposing one another, for coupling them by means of inserting the pins securely into the openings. Obviously, another type of coupling configurations are also possible, such as conjugated surface configurations defined in the coupling bases or directly by means of adhesive.

Alternatively or complementarily, the mentioned complementary coupling configurations comprise, respectively, one or more appendages with a hook configuration at the free end thereof and one or more holes (generally through holes) arranged, respectively, in the coupling bases opposing one another, and configured for being coupled by the elastic deformation and recovery of each appendage when being inserted into the hole opposing same, the hook configuration retaining one of the annular guide half-components against the other.

Optionally, both half-components can also be coupled by external coupling means (such as flanges), without the coupling bases having to have the mentioned coupling configurations.

A second aspect of the invention relates to a method for forming a toroidal coil which comprises using the device of the first aspect for forming a toroidal coil, with one or more windings.

According to one embodiment of the method proposed by the second aspect of the invention, the method comprises winding the turns around the toroidal magnetic core, inserting the naked core into the housing defined by the central space of the annular guide component, and passing the wire, alternatively, through the channels of the annular guide component and through the central area demarcated by the inner wall of the toroidal magnetic core, following a process similar to a sewing process.

For an alternative embodiment, in relation to the case in which the coil is already partially formed because a winding step has been performed, but the quality of the already wound toroidal coil is not considered acceptable because the turns thereof are not well ordered, for example, they are not arranged equidistantly, the method comprises ordering the turns of an already wound toroidal magnetic core, inserting it into the housing defined by the central space of the annular guide component by positioning the turns in the channels of the annular guide component, one turn per channel.

Once the turns have been formed and positioned following the predetermined order of the annular guide component, or before winding, the method comprises for the two alternative embodiments described above generally applying a series of fixing points around the coil to prevent the turns from being able to move and come out of the ordered positions, for example by means of an adhesive or by means of double-sided tape, in this last case placing the tape on the outer diameter of the core before the process of winding the turns, so that the turns are fixed thereto upon winding. An adhesive curing step is then performed.

Advantageously, a varnishing step is also applied for varnishing the turns and the annular component is removed thereafter.

According to one embodiment, the method comprises forming at least one pair of toroidal coils with identical or almost identical orders of turns, using the same annular guide component or two components with identical or almost identical orders of channels, for use thereof in wireless charging systems by means of inductive coupling.

According to another embodiment, the method comprises forming a toroidal coil with two windings with identical or almost identical orders of turns with respect to one another, and with such symmetry between the windings that the difference between the respective inductances forming each of windings is very small, preferably less than 2%.

BRIEF DESCRIPTION OF THE DRAWINGS

The foregoing and other advantages and features will be better understood based on the following detailed description of several embodiments in reference to the attached drawings which must be interpreted in an illustrative and non-limiting manner, in which.

DETAILED DESCRIPTION OF SEVERAL EMBODIMENTS

Figure 1A:
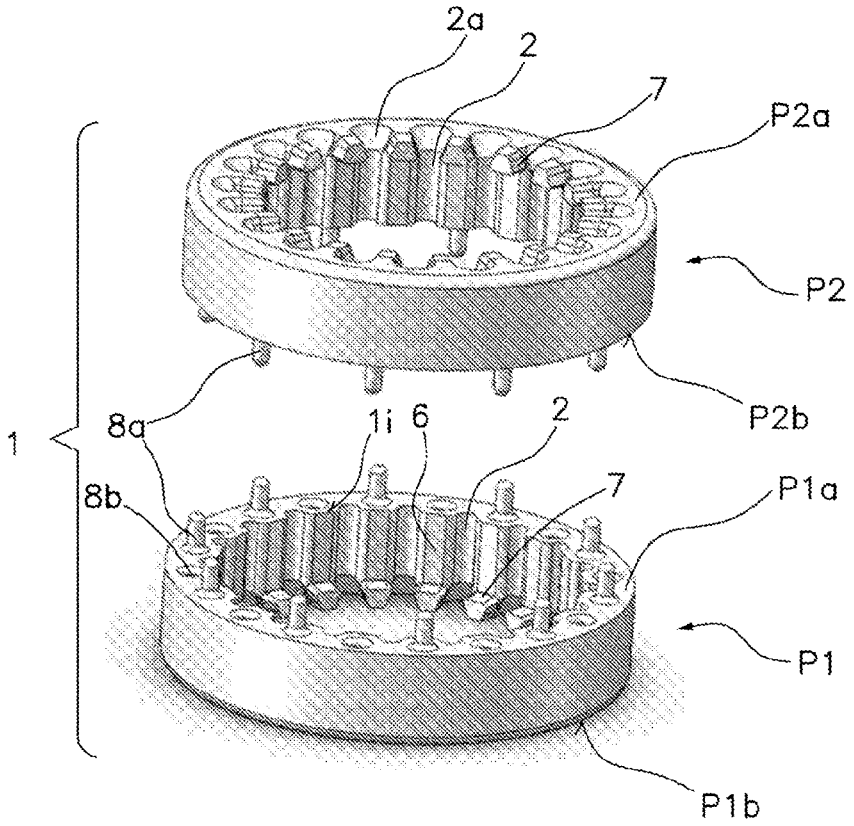
FIG. 1*a* shows by means of a perspective view the device proposed by the first aspect of the invention, for one embodiment in which the annular guide component comprised in the device comprises two half-components or parts that can be coupled to one another, both half-components being illustrated uncoupled and spaced from one another.

As illustrated particularly in FIGS. 1*a*, 1*b*, 2 and 3, the device for forming a toroidal coil proposed by the first aspect of the present invention comprises a annular guide component 1 with an annular inner wall 1*i* demarcating a central space 5 for accommodating the toroidal magnetic core 4, and comprising a plurality of channels 2 arranged transversely, from base to base of the annular guide component 1, distributed equidistantly and in parallel throughout the annular inner wall 1*i* with respect to one another and with respect to the geometric central axis of the annular guide component 1.

The channels 2 are provided for receiving portions of a wire that form the turns 3 of the toroidal coil when being arranged around the toroidal magnetic core 4.

The central space 5 is demarcated by interstitial portions 6 between channels 2 of the annular inner wall 1*i* and has a diameter larger than the outer diameter of the toroidal magnetic core 4.

Figure 1B:
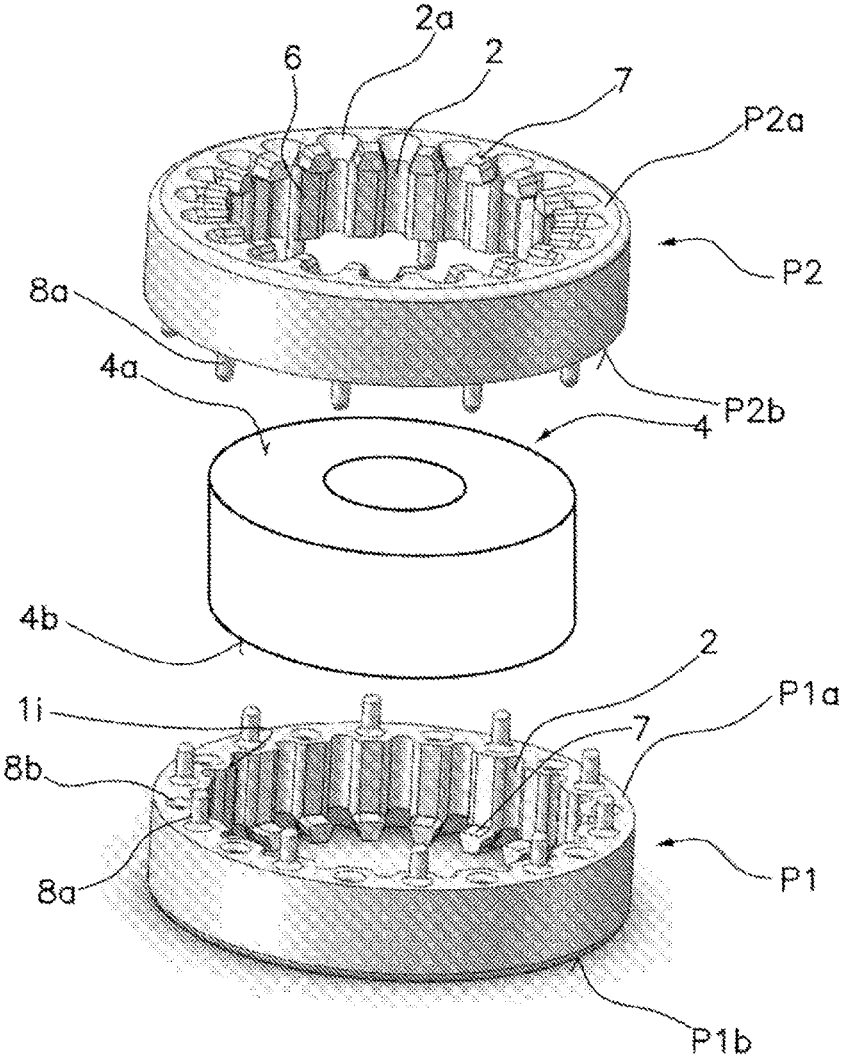
FIG. 1*b* shows an exploded view similar to that of FIG. 1*a* but also illustrating the naked toroidal magnetic core arranged between both half-components in a situation before being trapped between both and before being wound.
Figure 2:
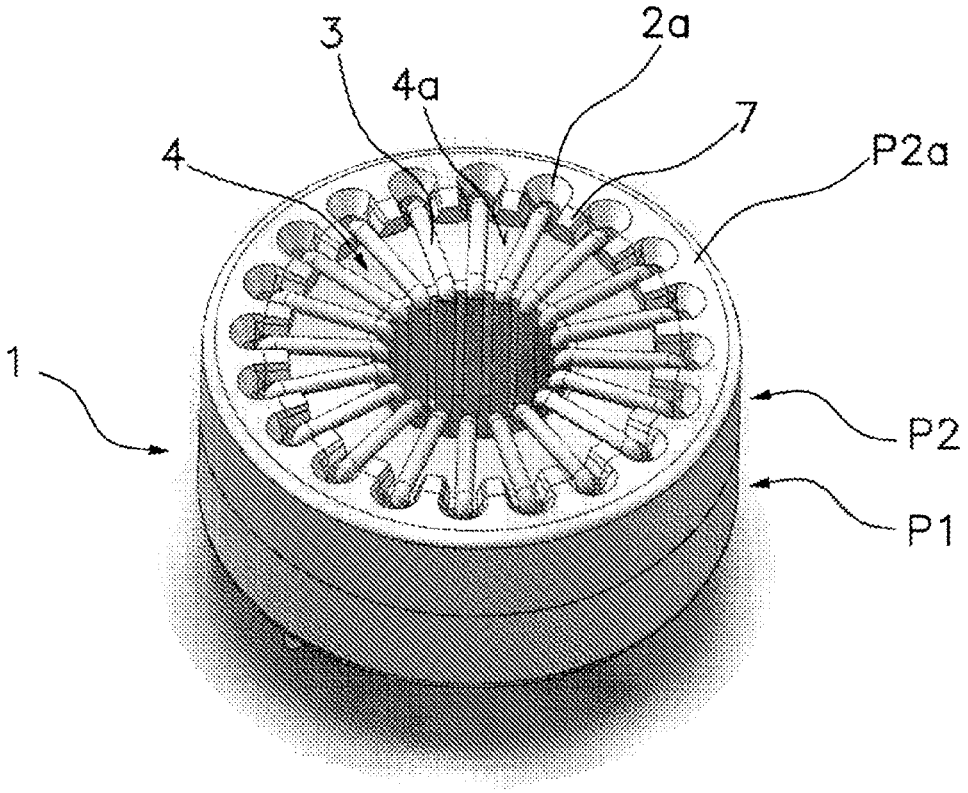
FIG. 2 illustrates the same embodiment as FIGS. 1*a* and 1*b* but shows the half-components once coupled to one another, with the toroidal magnetic core already wound and trapped between both.

In the embodiment of FIGS. 1*a*, 1*b* and 2, the annular guide component 1 comprises two annular guide half-components or parts P1, P2 that can be coupled to one another at two of their respective opposing bases P1*a*, P2*b*, or coupling bases, and each of the annular guide half-components P1, P2 comprises a plurality of projections 7 at one end of their respective interstitial portions 6 for supporting the toroidal magnetic core 4 by both of its larger faces or bases 4*a*, 4*b*, i.e., the core 4 is trapped between the projections 7 close to the base P1*b* and the projections 7 close to the base P2*a* (the latter being illustrated as contacting the larger face 4*a* in FIG. 2).

Adjacent to said projections 7, each of the channels 2 has a conical expansion 2*a* which facilitates the entry of the copper wire, for the case in which the winding is performed using the guide component 1, or the entry of the turns 3, for the case in which the guide component 1 is used for ordering the turns 3 of an already wound core.

As seen in FIGS. 1*a* and 1*b*, the coupling bases P1*a*, P2*b* comprise respective complementary coupling configurations which, for the embodiment therein illustrated, comprise respective pins 8*a* and openings 8*b* arranged in the coupling bases P1*a*, P2*b* opposing one another, for coupling them by means of inserting the pins 8*a* securely into the openings 8*b*, being securely attached as illustrated in FIG. 2.

Figure 3:
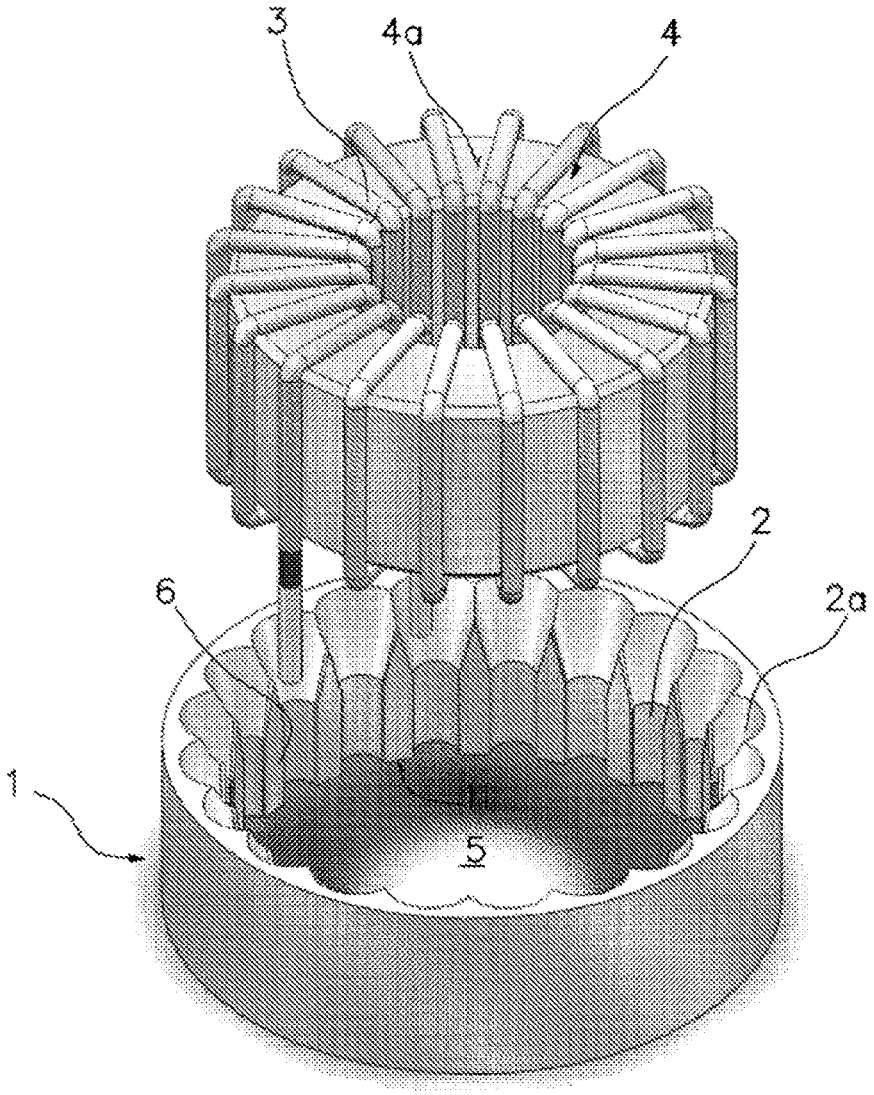
FIG. 3 shows a perspective view illustrating the device proposed by the first aspect of the invention, for one embodiment in which the annular guide component is a single component, and an already wound toroidal magnetic core is in a situation before being inserted into the housing defined by the guide component, for the case in which the latter is used only for ordering already formed turns, or in a situation before being extracted from such housing, for the case in which winding has been performed by means of the guide component.
Figure 4:
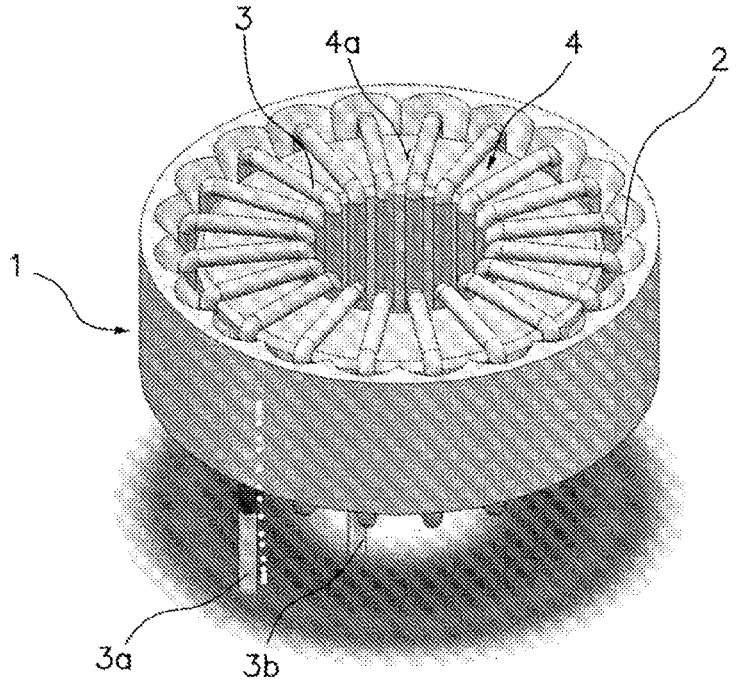
FIG. 4 shows the same elements as FIG. 3 but with the core inserted in the housing defined by the annular guide component.
Figure 5:
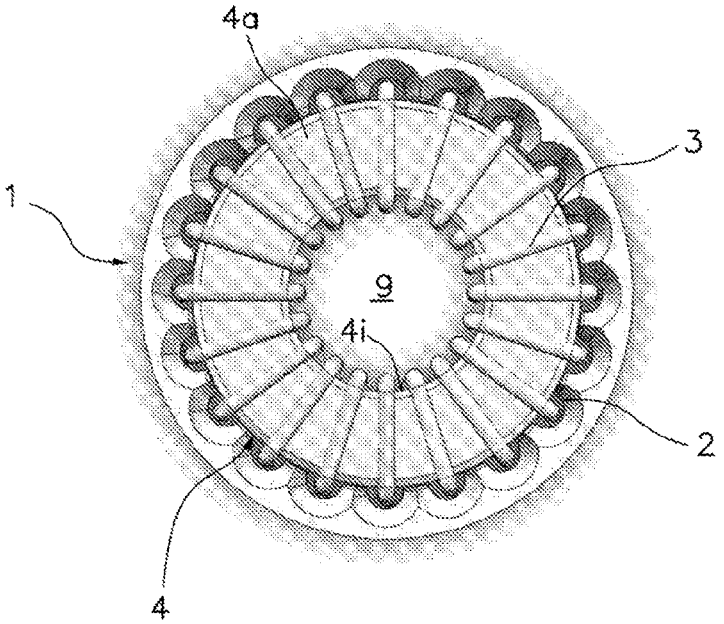
FIG. 5 is a top plan view of the elements illustrated in FIG. 4.

For the embodiment illustrated in FIGS. 3, 4 and 5, the annular guide component 1 is a single component, and the channels 2 have the mentioned conical expansion 2*a* defined at one end of the channels. FIG. 4 shows the ends 3*a* and 3*b* of the wire that forms the turns 3 of the toroidal coil.

As described in a preceding section, the method proposed by the second aspect of the invention comprises using the device of the first aspect for winding a naked magnetic core 2 or, alternatively, for ordering the turns 3 of an already wound core 4.

In the first case, the core 4 is inserted into the central space 5 of the annular guide component 1, inserting it directly through one of its faces for the embodiment of FIG. 3 or into one of the half-components P1, P2 for the embodiment of FIGS. 1*a*, 1*b* and 2, after which the other half-component P2, P1 is arranged on the core 4, trapping it between both. Once the core 4 has been arranged in the housing 5, winding is performed by inserting the copper wire through one end of one of the channels 2, taking it out through the other end, passing it through the central area 9 (see FIG. 5), inserting it through the lower end of the adjacent channel 2, and so on and so forth until completing the winding, following a process similar to a sewing process. After the winding has been completed, the component 1 is preferably removed, i.e., the end product does not include the component 1, but only the toroidal coil thus formed.

To prevent the turns 3 from coming out of the adopted positions and to protect same from adverse environmental conditions, before removing the annular component 1 a fixing step for fixing the turns 3 to the core 4 is performed, for example, by means of an adhesive or double-sided adhesive tape. This fixing step, at least when it is performed using a double-sided adhesive tape, is carried out before winding the turns, placing the tape on the outer diameter of the naked core, so that the turns are fixed thereto upon winding. An adhesive curing step is then performed. Once the turns 3 are duly positioned, they are varnished, therefore being securely fixed and protected from adverse environmental conditions. The annular component 1 is again used for forming other coils.

Preferably, the annular component 1 cannot be removed, being included in the end product.

For the second case, i.e., the case of ordering the turns 3 of an already wound core 4, the latter is inserted in the manner similar to that explained in the preceding paragraph but positioned such that the turns 3 enter the channels 2 (through the expansions 2*a* for the embodiment of the FIG. 3), such that channels force the turns 3 to move in a guided manner until each of them is being centrally positioned in a respective channel 2. After that, the turns 3 are fixed to the core 4 by means of an adhesive that is subsequently cured, so that when the guide component 1 is removed the turns do not come out of the adopted ordered position, and they are varnished so that they are protected against adverse environmental conditions.

Figure 6:
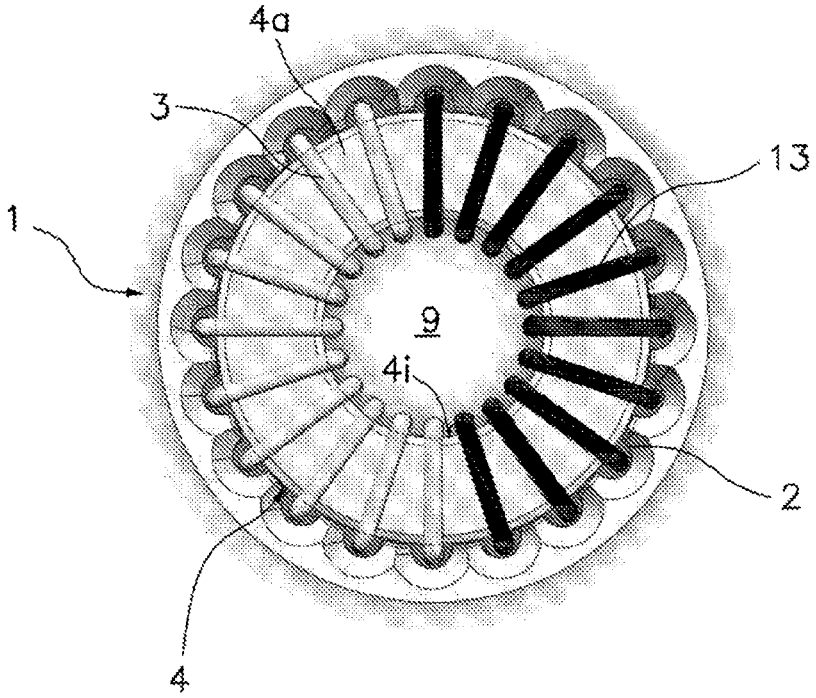
FIG. 6 shows a view similar to that of FIG. 5, but for one embodiment in which the toroidal coil includes two windings with identical or almost identical orders of turns with respect to one another.
Figure 7:
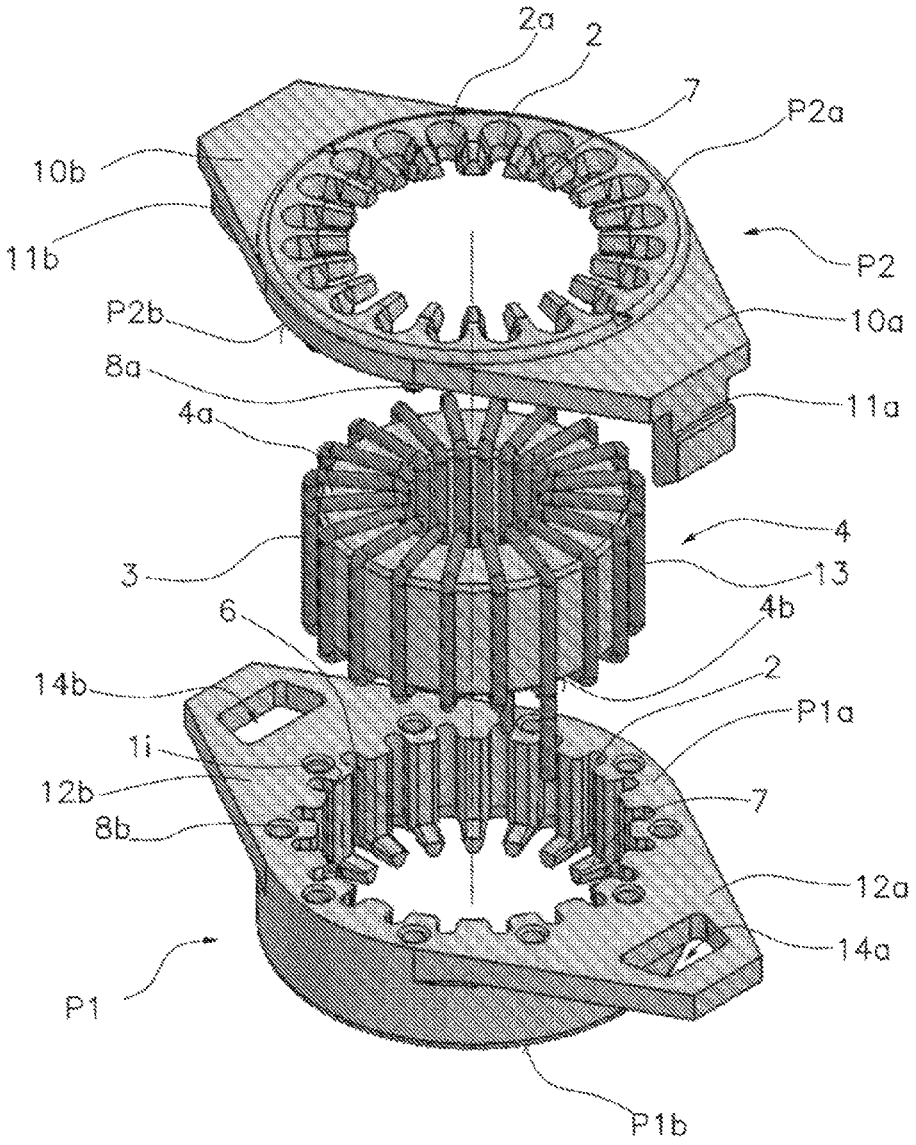
FIG. 7 illustrates by means of an exploded perspective view the device proposed by the first aspect of the invention for another embodiment similar to that of FIG. 1*b*, but where the half-components include tabs with complementary coupling means.

FIG. 6 illustrates a preferred embodiment that differs from the embodiment of FIG. 5 in that the toroidal coil includes two windings, one formed by the turns 3 and the other formed by the turns 13, with identical or almost identical orders of turns with respect to one another. Obviously, for this embodiment the illustrated windings can be obtained according to any of the two alternative cases explained above in reference to the method proposed by the second aspect of the invention, i.e., for winding a naked magnetic core 2 or, alternatively, for ordering the turns 3, 13 of an already wound core 4.

FIGS. 7, 8*a*, 8*b* and 8*c* illustrate an embodiment more similar to the embodiment of FIGS. 1*a*, 1*b* and 2, but in which, in addition to the pins 8*a* and openings 8*b*, the complementary coupling configurations comprise, respectively, two appendages 11*a*, 11*b*, each of them with a hook configuration at the free end thereof (particularly in the form of a rim or catch), and two through holes 14*a*, 14*b* arranged, respectively, in the coupling bases P2*b*, P1*a* opposing one another, and configured for being coupled by the elastic deformation and recovery of each appendage 11*a*, 11*b* when being inserted into the through hole 14*a*, 14*b* opposing same, the hook configuration retaining one of the annular guide half-components P1 against the other P2. Although the drawings depict the appendages 11*a*, 11*b* as being arranged in the half-component P2 and the through holes 14*a*, 14*b* in the half-component P1, for other embodiments (not illustrated) the situation can be the opposite or the appendages and holes in each of the half-components P1, P2 can be combined. The appendages and holes may also not be two in number, for other non-illustrated embodiments.

For the embodiment illustrated in FIGS. 7, 8*a*, 8*b* and 8*c*, the annular guide semi-component P2 comprises two tabs 10*a*, 10*b* extending outwards from two opposite parts or regions of the outer contour thereof and each of them comprising one of the two appendages 11*a*, 11*b*. Likewise, the annular guide semi-component P1 also comprises two tabs 12*a*, 12*b* extending outwards from two opposite parts or regions of the outer contour thereof and each of them comprising one of the two through holes 14*a*, 14*b*.

As can be seen in FIGS. 7, 8*a*, 8*b* and 8*c*, each pair of tabs 10*a*, 10*b* and 12*a*, 12*b* are located on a respective plane, both planes being parallel to one another and transverse to the geometric central axis of the annular guide component 1, in the illustrated case, orthogonal to said geometric central axis. For other non-illustrated embodiments, such planes are not orthogonal to the geometric central axis.

Figure 8A:
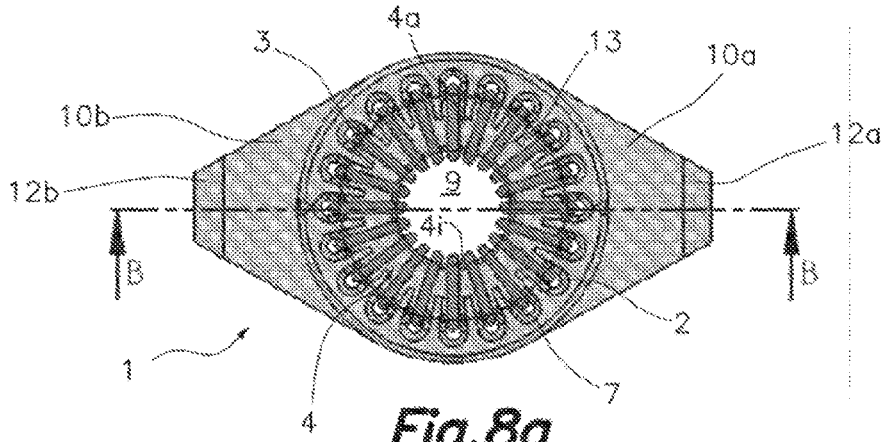
FIGS. 8*a*, 8*b* and 8*c* illustrate the same embodiment as FIG. 7 but with the half-components coupled to one another and the wound toroidal magnetic core trapped between both, by means of a top plan view, a sectioned elevational view taken through the section plane indicated by line B-B in FIG. 8*a*, and an elevational view, respectively.

Likewise, for the illustrated embodiment the tabs of each pair of tabs 10*a*, 10*b* and 12*a* 12*b* are symmetrical to one another with respect to the axis of symmetry passing through section line B-B in FIG. 8*a* and with respect to an axis of symmetry perpendicular to B-B.

For other embodiments (not illustrated), the number of tabs, their shape and arrangement, including the non-coplanarity and/or asymmetry of the tabs 10*a*, 10*b* and 12*a*, 12*b* of each half-component P1, P2, can be different from those illustrated.

Figure 8B:
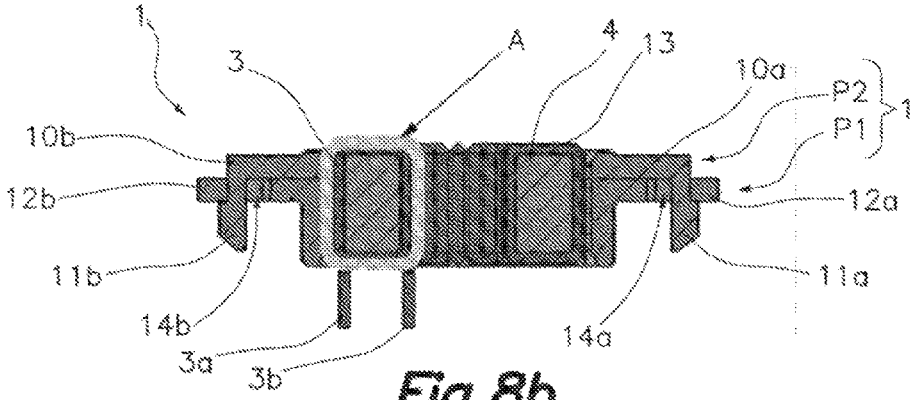
Figure 8C:
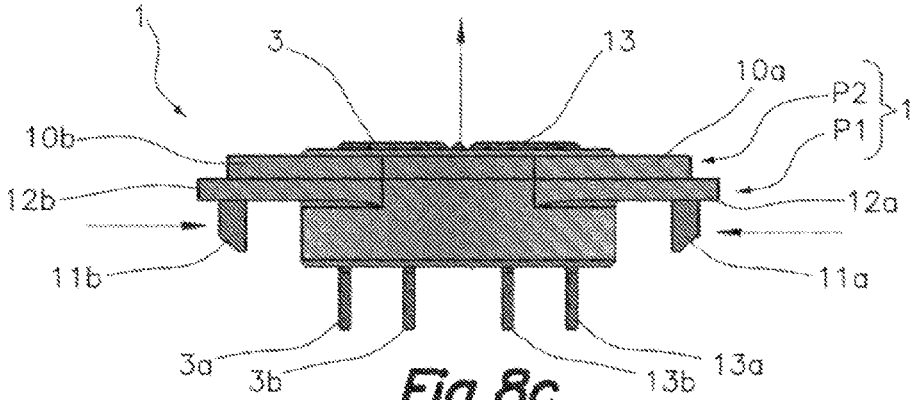

FIGS. 8*b* and 8*c* show how the hook configurations of the appendages 11*a*, 11*b* securely retain the tabs 12*a*, 12*b* against the tabs 10*a*, 10*b*, and therefore the half-component P1 against the half-component P2, once the two half-components P1, P2 have been coupled to one another. To uncouple both half-components, there is a need to press both hook configurations inwards, as indicated by the horizontal arrows in FIG. 8*c*, and pull on the half-component P2 as indicated by the vertical arrow of FIG. 8*c*, separating it from P1.

Like in the embodiment of FIG. 6, in the embodiment of FIGS. 7, 8*a*, 8*b* and 8*c* the toroidal coil includes two windings, one formed by the turns 3 and the other by the turns 13, the two pairs of ends, 3*a*, 3*b* and 13*a*, 13*b*, of the wires that form both turns 3, 13 being shown in FIG. 8*c*. For another embodiment similar to the embodiment of FIGS. 7, 8*a*, 8*b* and 8*c*, the windings included in the toroidal coil is not two in number.

The embodiment of FIGS. 7, 8*a*, 8*b* and 8*c* also differs from the embodiment of FIGS. 1*a*, 1*b* and 2 in that the height of the annular region of the half-component P2 is much smaller than the height of the half-component P1, in fact it coincides with the thickness of the tabs 10*a*, 10*b* and coplanar with respect to same. Slight variants of such embodiment (not illustrated) contemplate that the annular region of the half-component P2 has a height greater than the thickness of the tabs 10*a*, 10*b*, and/or is not coplanar with same.

A person skilled in the art would be able to introduce changes and modifications in the embodiments that have been described without departing from the scope of the invention as defined in the attached claims.

The invention claimed is:

1. A device for forming a toroidal coil, comprising a guide component including channels for receiving portions of a wire that form turns of said toroidal coil when being arranged around a toroidal magnetic core, said channels being defined on a face of said guide component to be arranged opposite an outer face of said toroidal magnetic core, said guide component has an annular shape with an annular inner wall demarcating a central space for accommodating the toroidal magnetic core, and comprises a plurality of said channels being distributed throughout said annular inner wall separated from one another in accordance with a predetermined order, wherein said central space is demarcated by interstitial portions between channels of said annular inner wall and has a diameter larger than an outer diameter of the toroidal magnetic core;

wherein the guide component comprises projections at least at one end of at least part of said interstitial portions for supporting the toroidal magnetic core at least by one of its annular bases;

wherein the guide component comprises two annular guide half-components that can be coupled to one another by two respective opposing coupling bases and said opposing coupling bases comprise respective coupling configurations; and wherein the guide component is removed once the turns of the wire are positioned and fixed on the toroidal magnetic core.

2. The device according to claim 1, wherein the channels of said plurality of channels are separated equidistantly from one another.

3. The device according to claim 1, wherein the channels of said plurality of channels are separated from one another according to different separation distances between channels or groups of channels.

4. The device according to claim 1, wherein said channels run parallel with respect to one another and with respect to the geometric central axis of the guide component.

5. The device according to claim 1, wherein each of said annular guide half-components comprises, at one end of at least part of the interstitial portions, a plurality of said projections, where said one end is close to or in contact with a first base of the opposing coupling bases of the annular guide semi-component opposite a second base of the opposing coupling bases, for supporting the toroidal magnetic core by both of the first base and the second base.

6. The device according to claim 1, wherein said opposing coupling bases comprise respective complementary coupling configurations.

7. The device according to claim 6, wherein said complementary coupling configurations are selected among:

complementary coupling configurations comprising respective pins and openings arranged in said opposing coupling bases opposing one another, for coupling the pins and openings by means of inserting the pins securely into the openings, and complementary coupling configurations comprising one or more respective appendages with a hook configuration at the free end thereof and one or more holes arranged respectively in said opposing coupling bases opposing one another, and configured for being coupled by elastic deformation and recovery of each appendage when being inserted into hole opposing same, the hook configuration retaining one of the annular guide half-components against the other.

8. The device according to claim 6, wherein said complementary coupling configurations comprise one or more respective appendages with a hook configuration at the free end thereof and one or more holes arranged respectively in said opposing coupling bases opposing-one another, and configured for being coupled by elastic deformation and recovery of each appendage when being inserted into a hole opposing same, the hook configuration retaining one of the annular guide half-components against the other; and wherein each of said annular guide half-components comprises one or more tabs extending outwards from at least part of an outer contour of the annular guide half-components in planes parallel to one another and transverse to the geometric central axis of the annular guide-half component, wherein said tabs comprise, respectively, said hole or holes, which are through holes, and said appendage or appendages.

9. The device according to claim 8, wherein each of said annular guide half-components comprises two of said tabs, each of them comprising one of said through holes or one of said appendages.

* * * * *